US009198269B2

(12) United States Patent
Bristow et al.

(10) Patent No.: US 9,198,269 B2
(45) Date of Patent: Nov. 24, 2015

(54) GROUNDING APPARATUS, SYSTEM AND METHOD

(71) Applicants: Bob Bristow, Minesing (CA); Darrell Lowden, New Lowell (CA); Doug Grantmyre, Angus (CA)

(72) Inventors: Bob Bristow, Minesing (CA); Darrell Lowden, New Lowell (CA); Doug Grantmyre, Angus (CA)

(73) Assignee: Honda Motor Co., Ltd., Tokyo (JP)

( * ) Notice: Subject to any disclaimer, the term of this patent is extended or adjusted under 35 U.S.C. 154(b) by 503 days.

(21) Appl. No.: 13/657,213

(22) Filed: Oct. 22, 2012

(65) Prior Publication Data

US 2013/0286529 A1 Oct. 31, 2013

(30) Foreign Application Priority Data

Nov. 3, 2011 (CA) ..... 2757243

(51) Int. Cl.

| | |
|---|---|
| ***H05F 3/00*** | (2006.01) |
| ***H05F 3/02*** | (2006.01) |
| ***B05B 5/08*** | (2006.01) |
| ***B05B 13/02*** | (2006.01) |

(52) U.S. Cl.

CPC *H05F 3/02* (2013.01); *B05B 5/082* (2013.01); *B05B 13/0285* (2013.01)

(58) Field of Classification Search

USPC ..... 361/217, 220, 230

See application file for complete search history.

(56) References Cited

U.S. PATENT DOCUMENTS

| | | | | |
|---|---|---|---|---|
| 2,553,724 | A * | 5/1951 | Ransburg | 118/635 |
| 2,632,068 | A * | 3/1953 | Froebel et al. | 200/51.07 |
| 4,171,100 | A | 10/1979 | Benedek et al. | |
| 4,260,849 | A | 4/1981 | Kirby | |
| 4,514,033 | A * | 4/1985 | Matthews | 439/729 |
| 4,998,178 | A * | 3/1991 | Weiss | 361/220 |
| 5,099,787 | A | 3/1992 | Powers | |
| 5,757,606 | A | 5/1998 | Westerberg | |
| 6,497,766 | B1 * | 12/2002 | Schang et al. | 118/500 |
| 2009/0108148 | A1 * | 4/2009 | Johnson | 248/176.3 |
| 2013/0286529 | A1 * | 10/2013 | Bristow et al. | 361/220 |

FOREIGN PATENT DOCUMENTS

| | | |
|---|---|---|
| JP | 3109967 | 5/1991 |

* cited by examiner

*Primary Examiner* — Ronald W Leja
(74) *Attorney, Agent, or Firm* — Rankin, Hill & Clark LLP

(57) ABSTRACT

Disclosed herein are different embodiments of a grounding apparatus, system and method, for use, in accordance with some embodiments, to ground an object to be coated in an electrostatic coating process. The apparatus generally comprises a structure and cover moveable relative to one another between a conductor receiving position and a covering position, such that a grounding conductor received therebetween may be conductively coupled therewith and at least partially covered thereby in the covered position. A removable grounding apparatus is also disclosed for positioning on an object support proximate a selected grounding location of the object.

37 Claims, 9 Drawing Sheets

GROUNDING APPARATUS, SYSTEM AND METHOD

FIELD OF THE DISCLOSURE

The present disclosure relates to grounding means, and in particular, to a grounding apparatus, system and method for use in electrostatic coating processes and the like.

BACKGROUND

Electrostatic coating processes are well known in the art for providing efficient surface coatings. For instance, paint in the form of powdered particles or atomized liquid can be projected towards an object to be coated and accelerated toward this object via an electrostatic charge applied thereto. By keeping the surface of the object to be coated charge-neutral, for example via one or more grounding mechanisms, the charged paint particles can adhere to this surface via electrostatic bonding. The bonded paint/coating can then be dried/cured, for example via conveyance of the coated object from a painting enclosure to a drying/curing enclosure in a manufacturing process.

In general, electrostatic coating processes are applied to metallic surfaces; however, non-conductive objects can also be subject to electrostatic coating. For example, plastic trim components utilized in automobile manufacturing plants, or the like, are routinely coated via electrostatic coating, namely in some examples, via preprocessing of the surface(s) to be coated to render such surfaces conductive. These and other such techniques will be readily known and understood by the person of ordinary skill in the art.

While offering certain advantages over conventional coating processes, such as generally providing greater transfer efficiencies, electrostatic coating processes also provide certain challenges. For example, to avoid charge buildup on the coated object and/or surrounding articles, which can pose a significant workshop hazard and also reduce the efficiency and quality of the coating process, efficient grounding must be maintained during the coating process, both for the object/surface to be coated and surrounding equipment, such as object support racks and/or conveyor systems. To ensure satisfactory grounding, regular cleaning is required to reduce paint buildup, for example, and allow for equipment reuse (e.g. multiple production runs and/or multiple coatings for a same object). Accordingly, there is a constant need or desire to improve grounding techniques and equipment to increase or at least maintain grounding efficiency and resiliency while promoting reusability and/or a reduction in operator intervention, which can translate in significant productivity increases, particularly in the context of a manufacturing process and system.

Therefore, there remains a need for a grounding apparatus, system and method that overcome some of the drawbacks of known technologies, or at least, provides the public with a useful alternative.

This background information is provided to reveal information believed by the applicant to be of possible relevance to the present invention. No admission is necessarily intended, nor should be construed, that any of the preceding information constitutes prior art against the present invention.

SUMMARY

An object of the invention is to provide a grounding apparatus, system and method that overcome some of the drawbacks of known technologies, or at least, provide the public with a useful alternative. In accordance with an embodiment of the invention, there is provided an apparatus for grounding an object to be coated via an electrostatic coating process, the object having a grounding conductor coupled thereto, the apparatus comprising: a grounding element; and a ground cover structurally coupled to said grounding element; said ground cover and said grounding element being moveable relative to one another between a receiving position for receiving the grounding element for conductive coupling between said grounding element and said cover, and a covering position for at least partially covering said conductive coupling.

In accordance with another embodiment of the invention, there is provided a system for grounding an object to be coated via an electrostatic coating process, the object having a grounding conductor coupled thereto, the system comprising: a grounded support for supporting the object during the electrostatic coating process; and a grounding apparatus as described above; wherein said grounding apparatus is conductively coupled to said grounded support.

In accordance with another embodiment of the invention, there is provided an apparatus for grounding an object to be coated via an electrostatic coating process, the object having a flexible grounding conductor coupled thereto, the apparatus comprising: a structure and a correspondingly sized cover structurally coupled together and moveable relative to one another between a receiving position for receiving the flexible grounding conductor between said structure and said cover, and a covered position in which said cover at least partially encases said structure such that the flexible conductor is at least partially wrapped around said structure within said cover, at least one of said structure and said cover providing a grounding surface such that the conductor is grounded via contact with said grounding surface when in the apparatus in said covered position.

In accordance with another embodiment of the invention, there is provided a method for grounding an object to be coated via electrostatic coating, using a grounding conductor, the method comprising the steps of: supporting the object on a grounded support; removably mounting a grounding apparatus on the support proximate a selected grounding location on the object; conductively coupling a first portion of the grounding conductor and the object at said selected grounding location; and conductively coupling a second portion of the grounding conductor and said grounding apparatus.

In accordance with another embodiment, the above method further comprises the step of at least partially covering said conductive coupling of said second portion and said grounding apparatus.

In accordance with another embodiment of the invention, there is provided a removable grounding apparatus for grounding an object to be coated via an electrostatic coating process, the object supported by a grounded support and having a first portion of a grounding conductor coupled to a selected location on the object, the apparatus comprising: a conductive clamping mechanism for coupling the apparatus to the support proximate the selected location; and a grounding mechanism for conductive coupling with a second portion of the conductor and for at least partially covering said conductive coupling with said second portion of the conductor.

Other aims, objects, advantages and features of the invention will become more apparent upon reading of the following non-restrictive description of specific embodiments thereof, given by way of example only with reference to the accompanying drawings.

BRIEF DESCRIPTION OF THE FIGURES

Several embodiments of the present disclosure will be provided, by way of examples only, with reference to the appended drawings, wherein.

DETAILED DESCRIPTION

Figure 1:
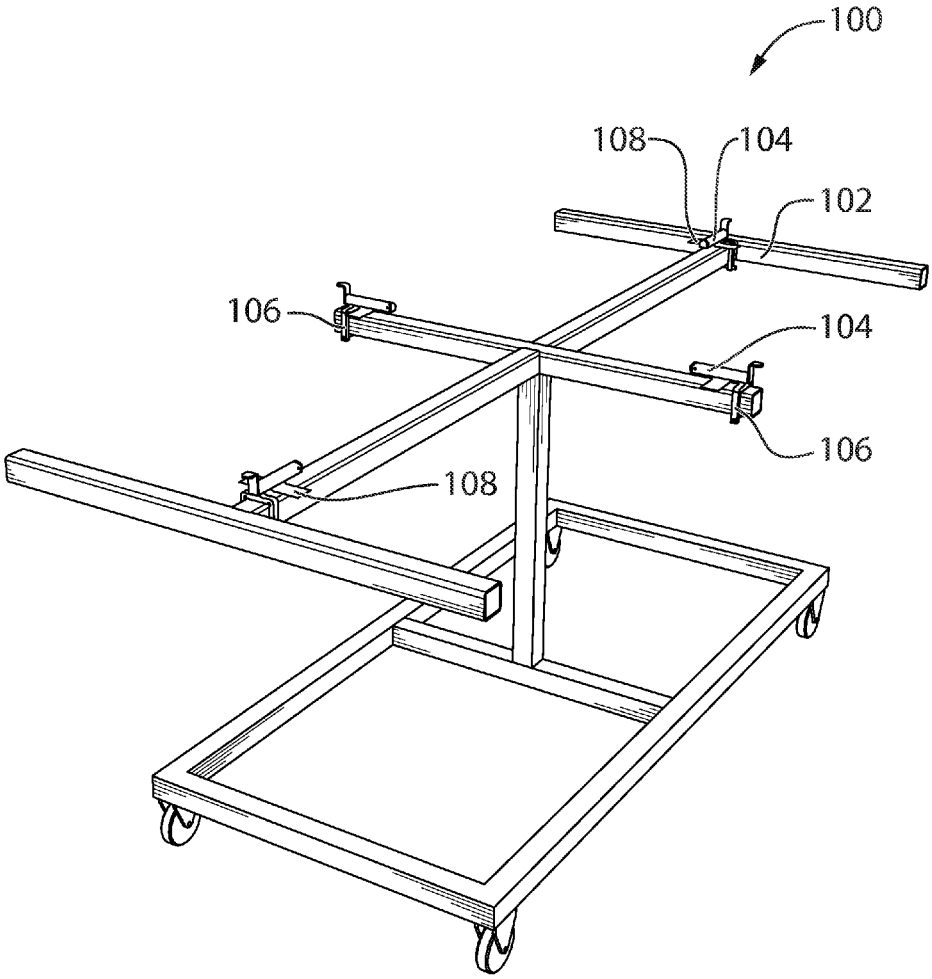
FIG. 1 is a perspective view of a grounding system for use in an electrostatic coating process, wherein one or more grounding mechanisms or apparatus are conductively mounted to a grounded or groundable support for supporting and grounding an object to be coated, in accordance with one embodiment of the invention.
Figure 2:
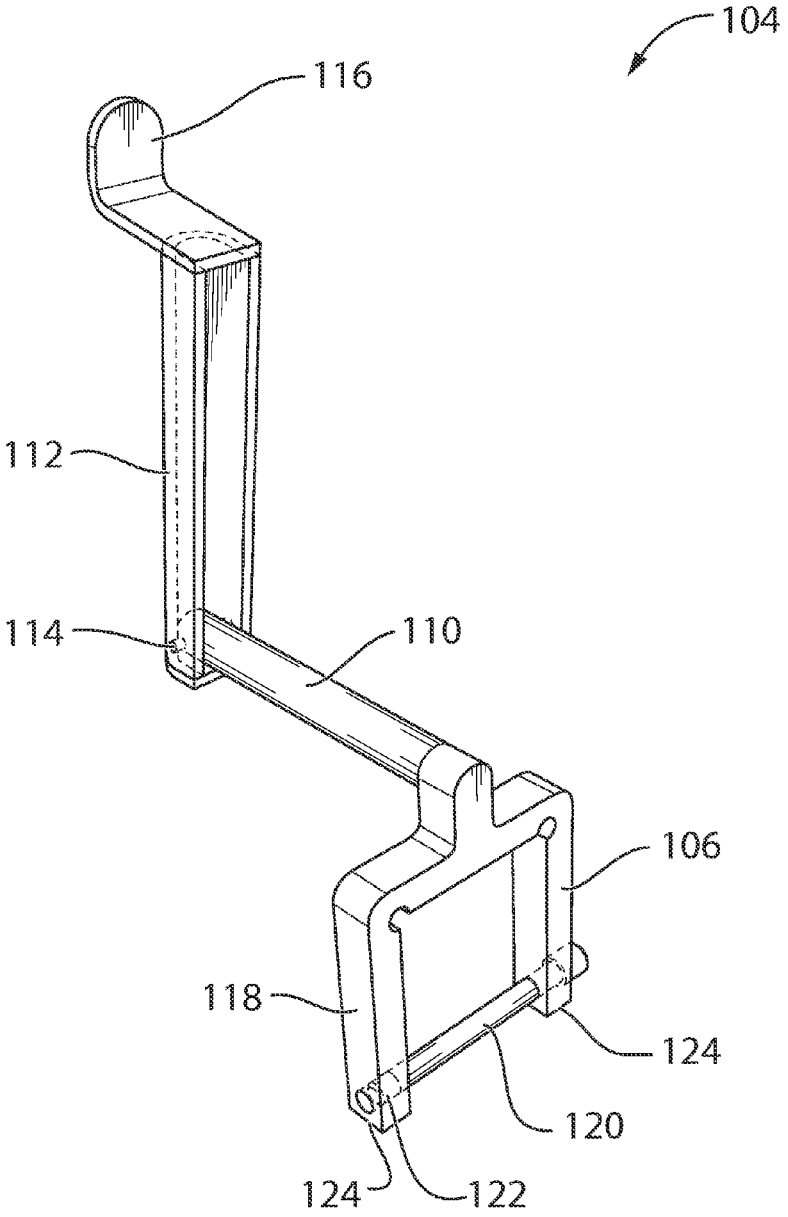
FIG. 2 is a perspective view of the grounding apparatus of FIG. 1.
Figure 3:
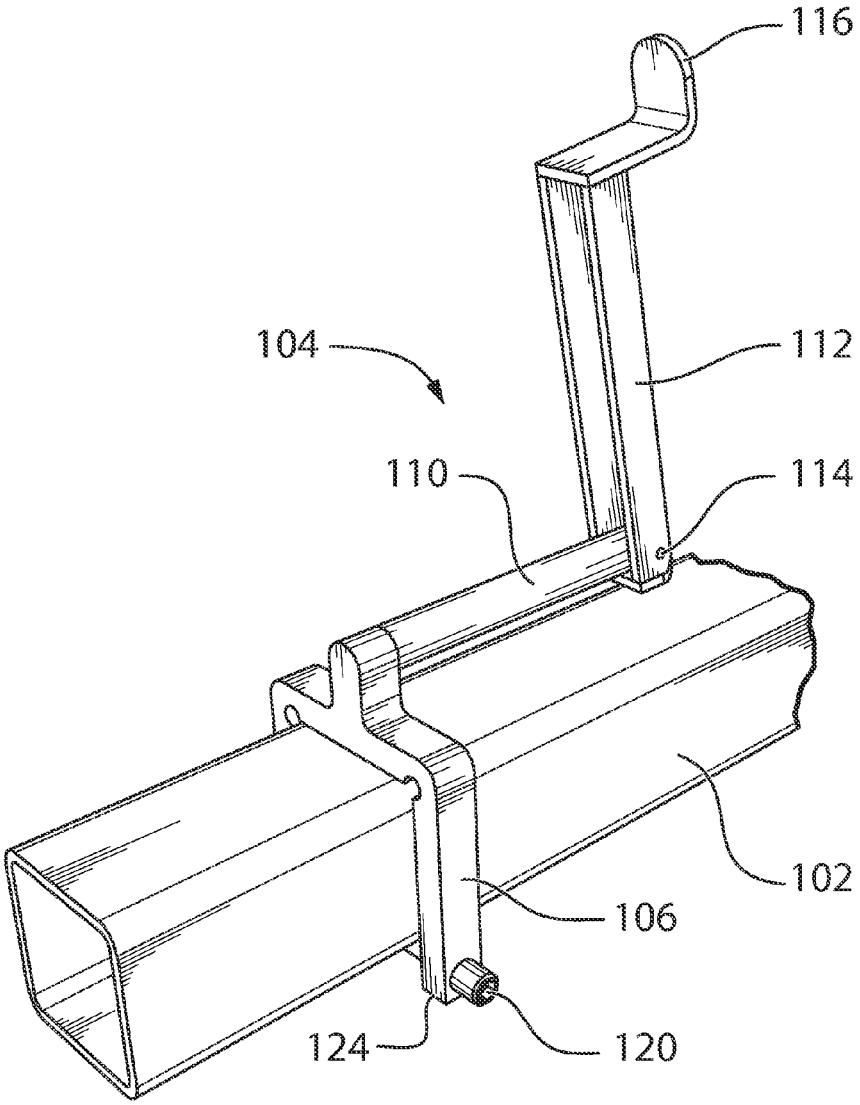
FIG. 3 is a perspective view of the grounding apparatus of FIG. 1 when mounted to the support.

It should be understood that the disclosure is not limited in its application to the details of construction and the arrangement of components set forth in the following description or illustrated in the drawings. The disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical or electrical connections or couplings. Furthermore, and as described in subsequent paragraphs, the specific mechanical or electrical configurations illustrated in the drawings are intended to exemplify embodiments of the disclosure. However, other alternative mechanical or electrical configurations are possible which are considered to be within the teachings of the instant disclosure. Furthermore, unless otherwise indicated, the term "or" is to be considered inclusive.

With reference to the disclosure herein and the appended figures, a grounding apparatus, system and method will now be described, in accordance with different embodiments of the invention. In particular, various embodiments of a grounding apparatus, system and method are described herein for the grounding of an object to be coated by an electrostatic coating process, or the like.

In some embodiments, the grounding apparatus comprises a structure and a correspondingly sized cover coupled together and moveable relative to one another between a receiving position for receiving a grounding conductor therebetween, and a covered position in which the cover at least partially covers a conductive coupling between the conductor and the grounding apparatus. In such embodiments, at least one of the structure and cover provide a grounding surface such that the conductor is grounded via contact with this grounding surface when in the apparatus in the covered position. For example, either or both of the structure and cover may be manufactured of a conductive material, such as metal or steal, or again manufactured so to comprise a conductive surface or coating material, such that the grounding conductor may be conductively coupled to the grounding apparatus by maintaining contact with this material. For instance, the structure may comprise a grounded or groundable structure, otherwise and interchangeably described herein as a grounding element, and/or the cover may comprise a grounded or groundable cover, whereby conductive coupling of the grounding conductor between the cover and structure in the covered position allows for effective grounding of the object to which the grounding conductor is coupled.

As will be discussed in greater detail below, during operation, the grounding apparatus will also be grounded, either directly or via a support provided to both support the object and ground same via the provided grounding apparatus. In the latter case, the grounding apparatus may either be fixedly coupled and/or integral to the support, or removably coupled thereto, for example via one or more clamping mechanisms or the like, as will be described in greater detail below.

For example, in one embodiment, one or more removable grounding apparatus may be provided to be conductively mounted to a grounded support at a location thereon proximate to a grounding location on the object to be coated. Namely, where the object is positioned on the support and where a grounding conductor is coupled to a selected location on the object to be coated, the removable grounding apparatus may be positioned on and conductively coupled to the grounded support proximate this selected location so to facilitate conductive coupling of the object to the grounding apparatus via this grounding conductor. These and other examples will be further discussed below with reference to different embodiments of the invention, some of which depicted in the accompanying figures.

With reference to FIG. 1, a system 100 for grounding an object to be coated (not shown) via an electrostatic coating process will now be described, in accordance with one embodiment of the invention. In this embodiment, the system generally comprises a grounded support 102 for supporting the object during the electrostatic coating process, and one or more grounding mechanisms or apparatus 104 for grounding the object via the support 102. In this embodiment, the grounding mechanisms 104 are shown as removably coupled to the support 102 via respective clamping mechanisms 106, discussed below, however, other embodiments may comprise grounding mechanisms otherwise coupled to the support 102, for example integrally and/or fixedly coupled via welding or the like, or other permanent, semi-permanent or temporary (i.e. removable) mechanical coupling means such as bolts, screws and the like, and/or combinations thereof.

In this particular embodiment, each grounding mechanism 104 is configured to allow conductive coupling of a grounding conductor, for example a flexible conductor such as foil tape 108 or the like (otherwise known as a ground strap), operatively coupled to the object to be coated, and the grounded support 102. As will be appreciated by the skilled artisan, the object may be coated via various electrostatic coating processes, which may include piece-by-piece coatings, for example by an operator working on a single object at a time, or in a chain manufacturing environment where successive objects are conveyed through an electrostatic coating chamber to be coated automatically. In any respect, to provide a safe work environment, the person of ordinary skill in the art will appreciate that the various components supporting the object, or otherwise provided in the context of a manufacturing process, should also be adequately grounded. Accordingly, while the support 102 is shown generally in FIG. 1, the skilled artisan will know how to adequately configure and adapt such support for the process at hand, and that, without departing from the general scope and nature of the present disclosure.

With added reference to FIGS. 2 to 5, each grounding mechanism 104 of this illustrative embodiment generally comprises a structure or grounding element 110 fixedly and conductively coupled to the clamping mechanism 106 for receiving the grounding conductor 108 thereon for conductive coupling therewith. Each grounding mechanism 104 further generally comprises a ground cover 112 structurally coupled to the grounding element 110, wherein the ground cover 112 and the grounding element 110 are moveable relative to one another between a receiving position (e.g. see FIG. 4), wherein the grounding conductor 108 can be received on the grounding element 110 for conductive coupling therewith, and a covered position (e.g. see FIG. 5) wherein this conductive coupling is at least partially covered by the ground cover 112. As will be appreciated by the skilled artisan, and as discussed above, in different embodiments, either or both of the grounding element 110 and cover 112 may provide for conductive coupling with the grounding conductor 108 to provide effective grounding of the object to be coated. Namely, the term "grounding element" is used herein for the sake of illustration and should not be construed to limit the scope of this description to an explicitly conductive element, and cooperative cover, but rather to provide context for the conductive coupling of the grounding conductor 108 between this element or structure 110 and corresponding cover 112 when in the covering position. Namely, other embodiments considered within the present context may be configured to provide a cooperating structure and cover in effectively grounding an object to be coated via an associated grounding conductor, and at least partially covering said grounding connection, wherein either or both of the structure and cover contribute to this grounding connection, either directly (e.g. manufactured of a conductive material) and/or via one or more intermediating surfaces (e.g. material coated or otherwise surfaced with a grounded conductive material), for example.

In this illustrative embodiment, the grounding element 110 generally consists of an elongate member such as a steel or metal bar/cylinder fixedly coupled to the clamping mechanism 106 so to provide and maintain a conductive coupling therewith, which conductive coupling thus effectively grounding the grounding element 110 upon conductive clamping of the apparatus 104 to a grounded support, such as support 102, via clamping mechanism 106. Examples of appropriate couplings may include, but are not limited to, welding, pressure fitted couplings, integrally molded or cast components and the like, as will be readily appreciated by the skilled artisan.

Again within the context of this illustrative embodiment, the ground cover 112 is generally structurally coupled to the grounding element 110, for example via pivot peg or bar 114, to pivot relative thereto and thus move between the conductor receiving position and covering position. In particular, the cover 112 generally consists of an elongate sleeve or cover shaped and sized to correspond and cooperate (e.g. for mating engagement) with the shape and size of the grounding element 110 so to at least partially encase the grounding element 110 in the covering position. In this embodiment, the cover is also manufactured of a conductive material such as metal or steel and is conductively coupled to the grounding element via pivot pin 114, whereby a conductor received and at least partially covered between the grounding element 110 and cover 112 is effectively grounded through all surface contacts with the grounding apparatus 104. The cover further comprises a handle, depicted herein as an L-shaped projection 116 to facilitate movement of the cover 112 to the conductor receiving position, which may be controllably returned to the covering position via this handle, or again moved under gravity upon releasing the cover 112.

Still in the context of this illustrative embodiment, the grounding apparatus 104 further comprises clamping mechanism 106, which generally consists of a fitted U-shaped structure 118 shaped and sized to fittingly engage a portion of the support 102, and a securing mechanism, such as bolt 120 extending through corresponding bores 122 provided at respective distal ends 124 of the U-shaped structure 118 and positioned so to secure the U-shaped structure 118 on the support 102. For example, bolt 120 may be fastened through bores 122 so to compress the distal ends 124 of the U-shaped structure 118 toward one another and against the support 102, thereby securing the clamping mechanism 106 thereto. Other securing mechanisms will be readily apparent to the person of ordinary skill in the art, as will other clamping mechanisms in general, without departing from the general scope and nature of the present disclosure. For example, while a specific example of a clamping mechanism is described herein, it will be appreciated that the term "clamping mechanism" is broadly used herein to encompass different mechanisms for clamping or otherwise removably and conductively securing the grounding mechanism to a given support.

Figure 4A:
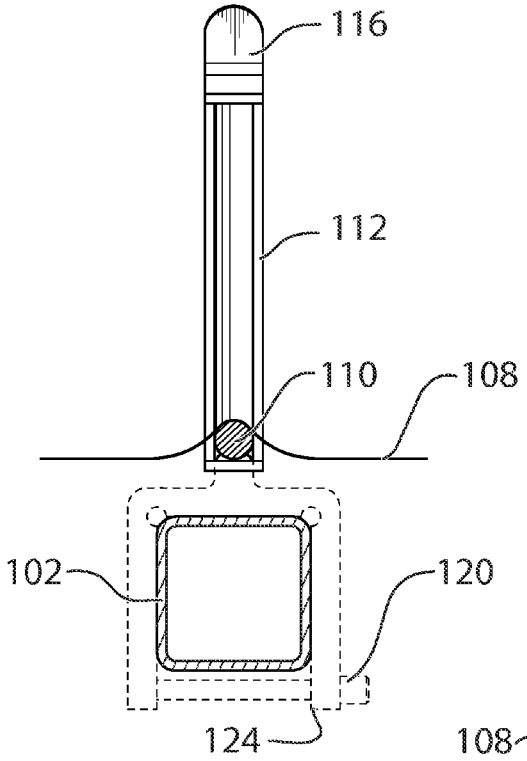
FIG. 4A is a cross-section of the grounding apparatus of FIG. 4 taken along line A-A thereof.
Figure 4:
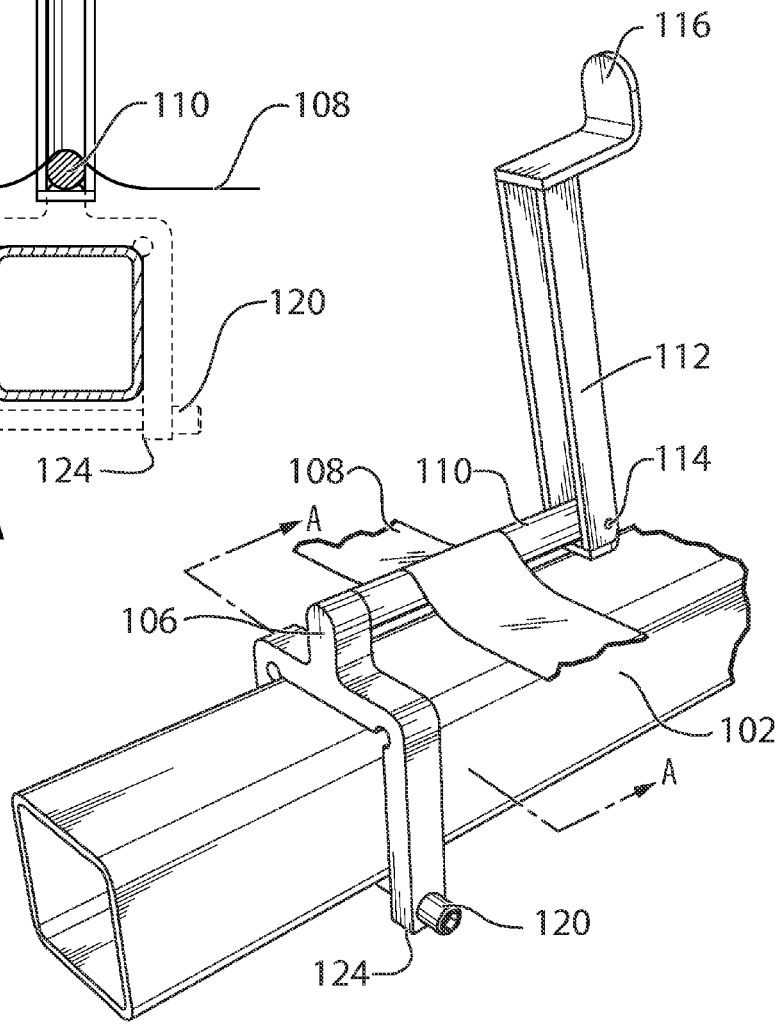
FIG. 4 is a perspective view of the grounding apparatus of FIG. 3 positioned to receive a grounding conductor for conductive coupling therewith, in accordance with one embodiment of the invention.
Figure 5A:
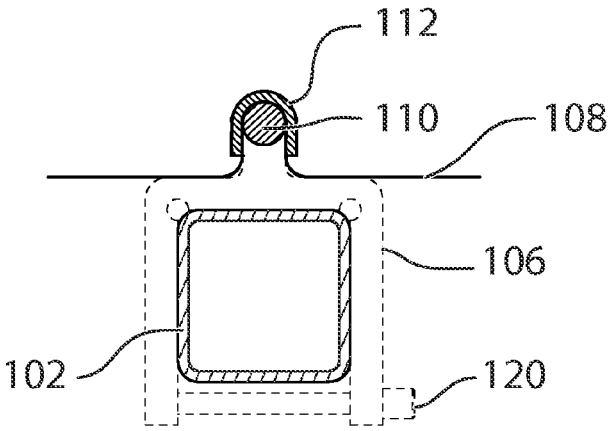
FIG. 5A is a cross-section of the grounding apparatus of FIG. 5 taken along line A-A thereof.
Figure 5:
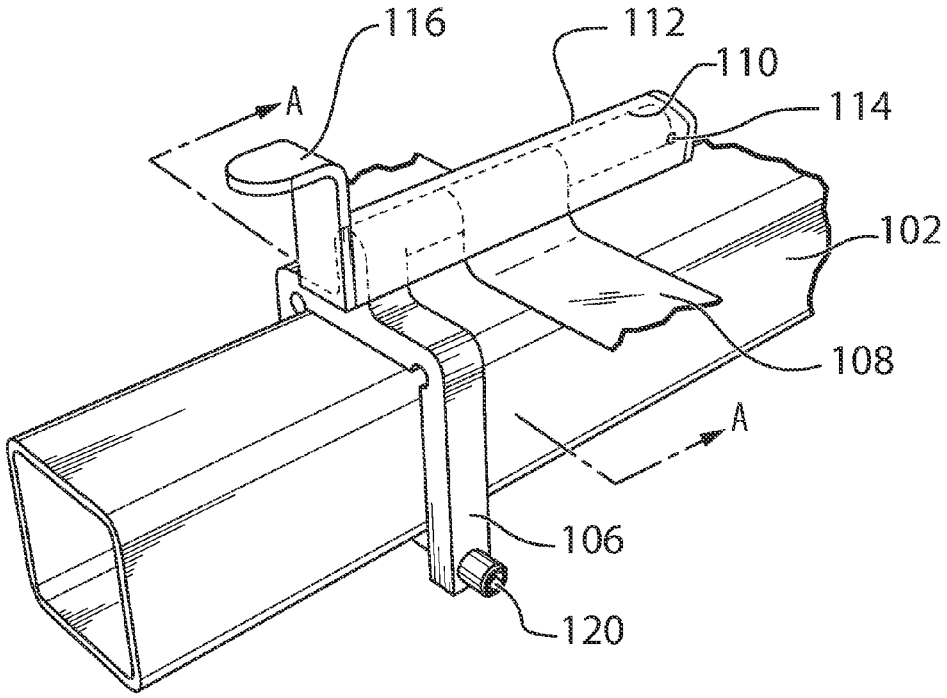
FIG. 5 is a perspective view of the grounding apparatus of FIG. 4 positioned to at least partially cover the conductive coupling, in accordance with one embodiment of the invention.

FIGS. 4 and 5 provide greater detail as to the grounding process. For example, in FIG. 4, the cover 112 is lifted in the conductor receiving position so to allow positioning of the conductor, depicted herein as a foil tape 108, between the grounding element 110 and cover 112. Upon lowering the cover 112 to the covering position, as shown in FIG. 5, the conductor 108 is partially wrapped around the grounding element 110 by the mating engagement of the cover 112 and grounding element 110, thus maintaining conductive coupling between the conductor 108 and the grounding apparatus 104 while at least partially covering this conductive coupling. It will be appreciated that while a foil tape is shown as grounding conductor 108 in the context of this illustrative embodiment, other types of grounding conductors, which may include but are not limited to other types of flexible conductors such tapes, wires, and the like, may also be considered herein without departing from the general scope and nature of the present disclosure.

Figure 6:
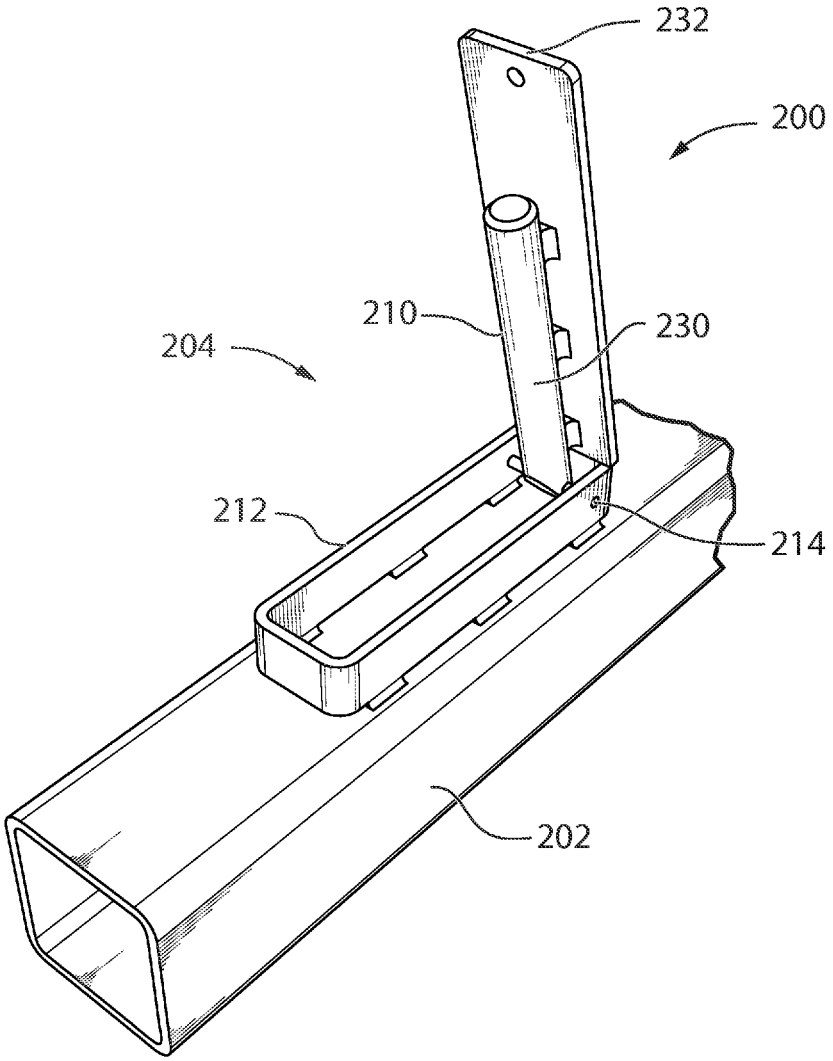
FIG. 6 is a perspective view of a grounding apparatus in a conductor receiving position, in accordance with another embodiment of the invention.
Figure 7:
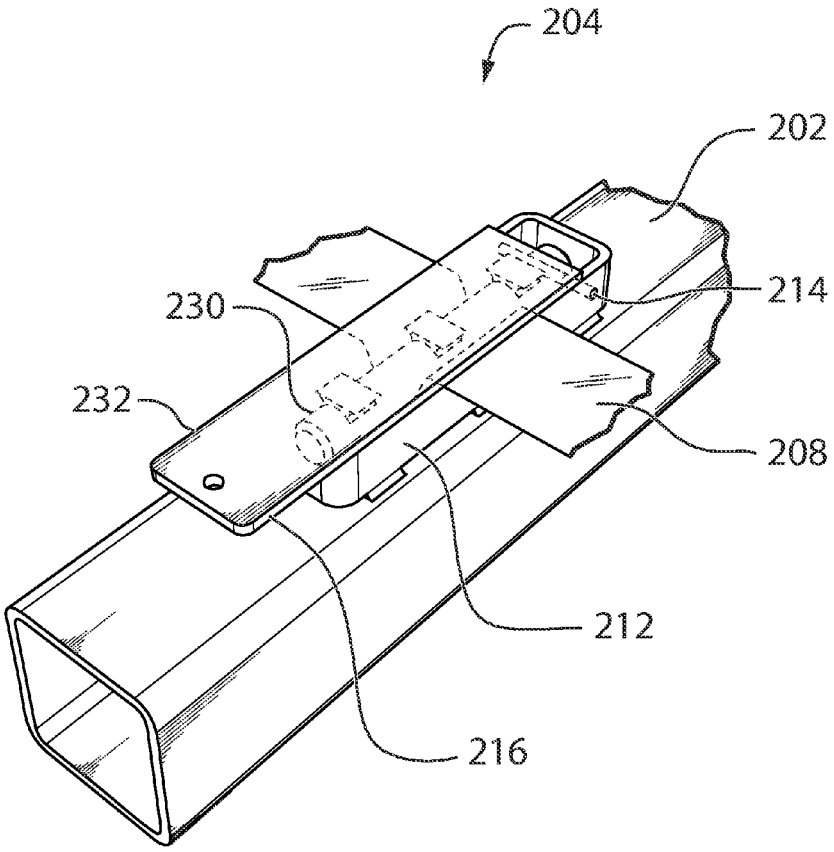
FIG. 7 is a perspective view of the grounding apparatus of FIG. 6 in a covering position.

Referring now to FIGS. 6 and 7, a grounding apparatus, generally referred to using the numeral 204 and in accordance with another embodiment of the invention, will now be described. The apparatus generally comprises a ground cover 212 fixedly coupled (e.g. welded) to support 202 to provide a conductive coupling therewith, and a grounding element or structure 210 structurally coupled thereto and moveable relative thereto between a receiving position (e.g. see FIG. 6), wherein a grounding conductor 208 can be received between the element 210 and cover 212 for conductive coupling therebetween, and a covering position (e.g. see FIG. 7) wherein this conductive coupling is at least partially covered by (e.g. within) the ground cover 212.

In this illustrative embodiment, the ground cover 212 generally consists of an elongate box or case manufactured of a conductive material such as steel or metal and fixedly coupled to the structure 202 to permanently provide and maintain a conductive coupling therewith, which conductive coupling thus effectively grounding the cover 212 and components conductively coupled therewith when the support 202 is effectively grounded.

In this embodiment, the structure 210 is generally structurally coupled to the cover 212, for example via pivot peg or bar 214 installed at an extremity thereof, to pivot relative thereto and thus move between the conductor receiving position and covering position. In this particular embodiment, the structure 210 generally consists of an elongate cylindrical member 230 welded or otherwise fixedly coupled to a substantially flat bar 232, whereby the cylindrical member 220 is shaped and sized to correspond with the shape and size of the cover 212 for mating engagement therewith in the covering position, thus at least partially covering or encasing a grounding conductor received therebetween. In this embodiment the structure 210 is also manufactured of a conductive material such as metal or steel and is conductively coupled to the grounded cover 212 via pivot pin 214 to further enhance grounding of a grounding conductor received therebetween in the covering position. As best shown in FIG. 7, the bar 232 generally extends beyond the cylindrical member 230 and cover 212 in the covering position to provide a handle 216 for actuating the structure 210 between receiving and covering positions.

Figure 8:
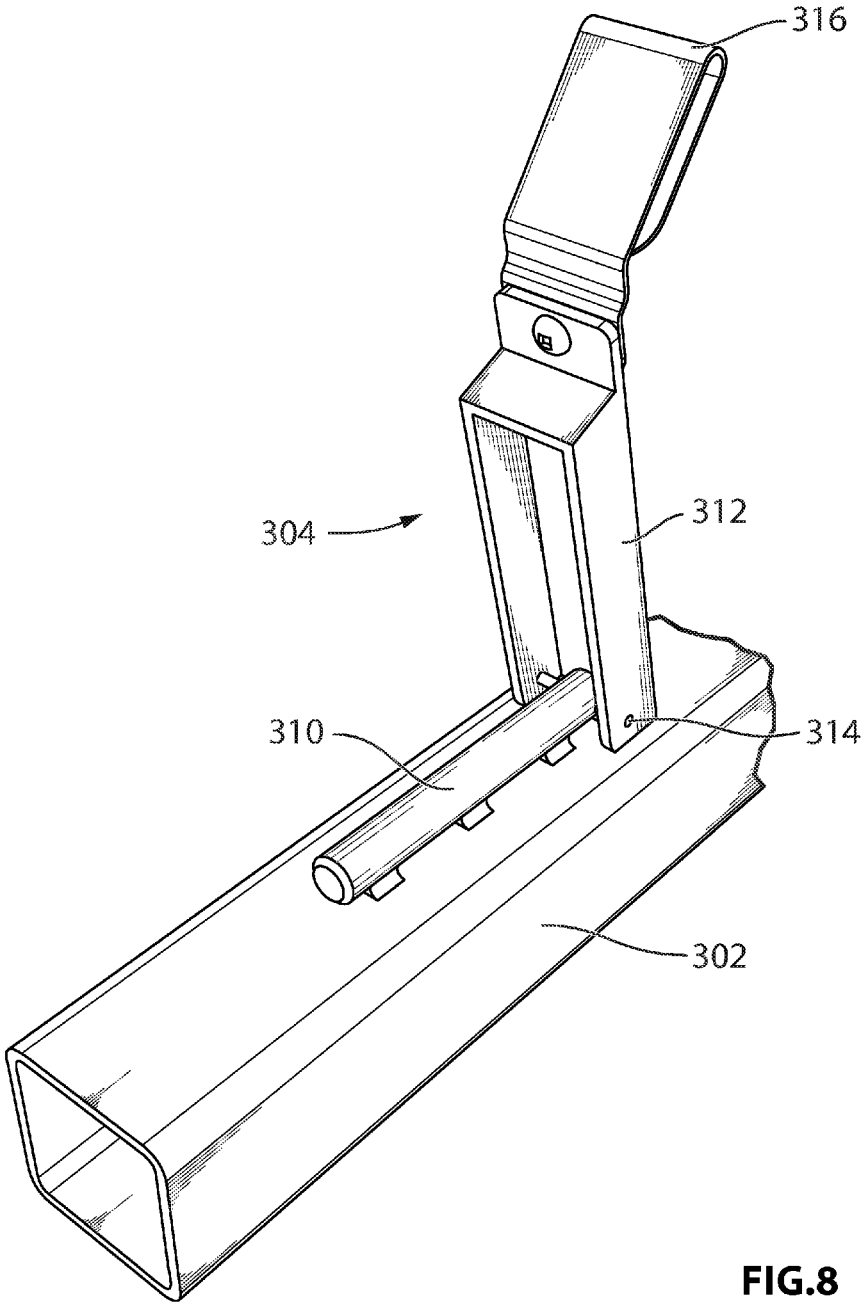
FIG. 8 is a perspective view of a grounding apparatus in a conductor receiving position, in accordance with another embodiment of the invention.
Figure 9:
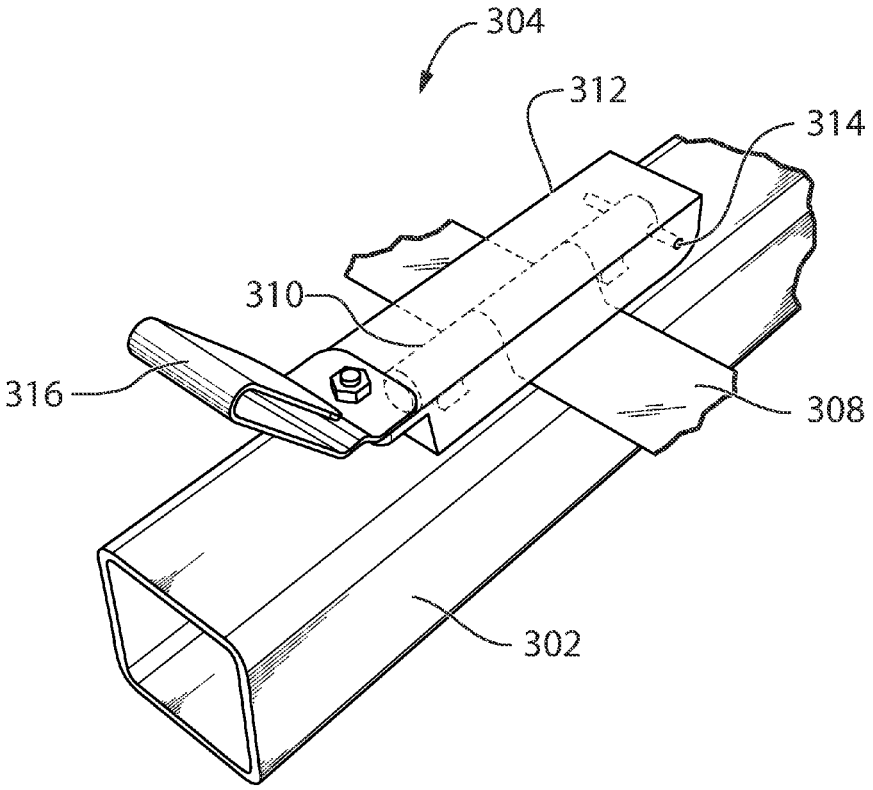
FIG. 9 is a perspective view of the grounding apparatus of FIG. 8 in a covering position.

Referring now to FIGS. 8 and 9, a grounding apparatus, generally referred to using the numeral 304 and in accordance with another embodiment of the invention, will now be described. The apparatus generally comprises a structure or grounding element 310 fixedly coupled (e.g. welded) to support 302 to provide a conductive coupling therewith, and a ground cover 312 structurally coupled thereto and moveable relative thereto between a receiving position (e.g. see FIG. 8), wherein a grounding conductor 308 can be received between the element 310 and cover 312 for conductive coupling therebetween, and a covering position (e.g. see FIG. 9) wherein this conductive coupling is at least partially covered by the ground cover 312.

In this illustrative embodiment, the element 310 generally consists of an elongate bar or member manufactured of a conductive material such as steel or metal and fixedly coupled to the structure 302 to permanently provide and maintain a conductive coupling therewith, which conductive coupling thus effectively grounding the element 310 and components conductively coupled therewith when the support 302 is effectively grounded. It will be appreciated that while a substantially cylindrical grounding element 310 is shown, other shapes and sizes may be readily considered herein without departing from the general scope and nature of the present disclosure.

In this embodiment, the cover 312 is generally structurally coupled to the element 310, for example via pivot peg or bar 314 installed at an extremity thereof, to pivot relative thereto and thus move between the conductor receiving position and covering position. In this particular embodiment, the cover 312 generally consists of an elongate box whereby the cylindrical grounding element 310 is shaped and sized to correspond with the shape and size of this box for mating engagement therewith in the covering position, thus at least partially covering or encasing a grounding conductor received therebetween. In this embodiment the cover is also manufactured of a conductive material such as metal or steel and is conductively coupled to the grounded structure 310 via pivot pin 314 to further enhance grounding of a grounding conductor received therebetween in the covering position. As best shown in FIG. 9, a cover handle 316 is fastened to the cover 312 and extends obliquely therefrom to facilitate actuation of the cover 312 between receiving and covering positions.

As will be appreciated by the skilled artisan, while the above embodiments describe a combination of a conductive structure and cover in forming an effective grounding connection with an associated grounding conductor, other material combinations may be considered herein to provide a similar effect. Namely, a non-conductive structure or element could be used to urge a grounding conductor against the interior of a conductive and grounded cover, just as a non-conductive cover could be used to urge such grounding conductor against and/or around a conductive and grounded structure or element. The person of ordinary skill in the art will note however that in order to ensure grounding of all exposed materials, the provision of a conductive cover and grounding element may provide some advantages over non-conductive combinations.

Furthermore, the skilled artisan will appreciate the potential advantages of a removable grounding apparatus, as described above in relation to FIGS. 1 to 5, wherein the grounding apparatus may be removably coupled to an associated support proximate a selected grounding location on the object, thus reducing the need for lengthy grounding conductors, for example. Furthermore, the provision of a removably mountable grounding apparatus may allow for the ready addition or removal of additional grounding mechanism, for example where multiple object grounding locations are selected for a given object. Also, such embodiments may be more readily amenable to being used in conjunction with existing supports, whereby different clamping mechanisms or the like may allow for interoperability with different types of supports. Nonetheless, embodiments intended to be permanently coupled to a support may still be readily used in conjunction with existing supports, wherein such grounding apparatus may be welded or otherwise fixedly coupled to such supports.

As will also be appreciated by the skilled artisan, the provision of a cover that is structurally coupled to the grounding element or structure may provide various advantages over similar designs where the cover is fully removable. For example, one fully removable implementation may involve the positioning of a grounding conductor over a protrusion, such as a bolt or the like, extending outwardly from a grounded support, which bolt and conductor may then be covered by a rubber grommet or plug to both secure and cover the grounding connection. In such an example, however, there may be increased risk of the cover being dislodged or falling, or again of the installation of such a cover on a flexible grounding conductor such as a foil tape or the like resulting in a sheering or tearing of the grounding conductor. Accordingly, lesser groundings may ensue as can risks of injury increase from tripping or slipping on a heavily coated and dislodged grommet, for example. Accordingly, the provision of a structurally coupled cover, as described above in accordance with some embodiments of the invention, reduces the likelihood of such covers being dislodged, lost or otherwise removed before, during or after processing, and thus promotes greater grounding consistency, effectiveness, and safety.

As will be readily appreciated by the skilled artisan, the above described embodiments and their equivalents can provide various additional or alternative advantages and benefits. For example, some embodiments may provide for a reduction in paint or coating buildup on the grounding connection, and/or provide for an increased stability of the grounding connection. By improving the ground effectiveness and reliability, associated advantages may include, but are not limited to, an improved coating consistency, appearance, and/or a reduction in drips, thins, sags and/or colour shifts; a reduction in overspray and/or greater control on coating material delivery, which may result in a reduction in paint use, VOCs and/or in the use of chemicals to assist in overspray control; and other such advantages as will be readily apparent to the skilled artisan.

It will also be appreciated that some embodiments may be readily manufactured from few parts to comprise few moving parts, thus making the manufacture of such embodiments readily achievable at low cost while remaining easy to use and sufficiently robust to withstand various implementation environments.

Furthermore, in some embodiments, for example those including a cylindrical grounding element engaging a correspondingly shaped and sized cover, the conductive coupling between the grounding conductor and grounding apparatus may be achieved without, of with reduced likelihood of forming a pinch point. It will be appreciated that different structure and cover shapes and sizes may lend themselves to different advantages, either in promoting enhanced ground couplings, for example where a grounding conductor is effectively wrapped, smoothed or urged between the structure and corresponding cover, or again in promoting greater ease of use and/or user operation, to name a few.

These and other advantages of the above described and other related embodiments will be readily apparent to the person of ordinary skill in the art, as will alternative apparatus shapes, sizes, structures, materials, manufactures and component couplings, which alternatives are thus considered to fall within the general scope and nature of the present disclosure.

While the present disclosure describes various exemplary embodiments, the disclosure is not so limited. To the contrary, the disclosure is intended to cover various modifications and equivalent arrangements included within the spirit and scope of the appended claims. The scope of the following claims is to be accorded the broadest interpretation so as to encompass all such modifications and equivalent structures and functions.

The invention claimed is:

1. An apparatus for grounding an object to be coated via an electrostatic coating process, the object having a grounding conductor coupled thereto, the apparatus comprising:

a grounding element; and a ground cover structurally coupled to said grounding element;

said cover and said grounding element being moveable relative to one another between a receiving position for receiving the grounding conductor for conductive coupling between the grounding conductor and one of said grounding element and said cover, and a covering position for at least partially covering said conductive coupling, and wherein said cover at least partially encases said grounding element when in said covering position.

2. The apparatus of claim 1, said cover and said grounding element being pivotally movable relative to one another via a pivot structurally coupling said cover and said grounding element.

3. The apparatus of claim 1, wherein said grounding element is elongate.

4. The apparatus of claim 3, said elongate grounding element and said cover being pivotally movable relative to one another via a pivot structurally coupling an extremity of said elongate grounding element within said cover.

5. The apparatus of claim 1, the object being supported by a grounded support, the apparatus further comprising a conductive coupling mechanism for conductively and removably coupling the apparatus to the grounded support thereby grounding the object.

6. The apparatus of claim 5, said coupling mechanism comprising a clamping mechanism for conductively clamping the apparatus to the grounded support.

7. The apparatus of claim 5, said coupling mechanism integrally coupled to said grounding element to thereby fixedly couple said grounding element to the support, said cover being moveable relative to said fixedly coupled grounding element for receiving the conductor.

8. The apparatus of claim 5, said coupling mechanism integrally coupled to said cover to thereby fixedly couple said cover to the support, said grounding element being moveable relative to said cover for receiving the conductor.

9. The apparatus of claim 1, wherein at least one of said grounding element and said cover are manufactured of a conductive material.

10. The apparatus of claim 1, said grounding element and said cover being shaped and sized for mating engagement when in said covering position.

11. The apparatus of claim 1, the grounding conductor comprising a flexible conductor, said cover being shaped and sized relative to said grounding element such that the flexible conductor is at least partially wrapped around said grounding element when in said covering position.

12. The apparatus of claim 1, the grounding conductor comprising a foil tape.

13. The apparatus of claim 1, wherein the object to be coated is a plastic vehicle part, the grounding conductor being coupled to a conductive surface of the plastic vehicle part.

14. The apparatus of claim 1, the object being supported by a grounded support, said cover being fixedly coupled to the grounded support, said grounding element being moveable relative to said cover for receiving the conductor.

15. The apparatus of claim 1, the object being supported by a grounded support, said grounding element being fixedly coupled to the grounded support, said cover being moveable relative to said grounding element for receiving the conductor.

16. A system for grounding an object to be coated via an electrostatic coating process, the object having a grounding conductor coupled thereto, the system comprising:

a grounded support for supporting the object during the electrostatic coating process; and a grounding apparatus as defined in claim 1;

wherein said grounding apparatus is conductively coupled to said grounded support.

17. The system of claim 16, further comprising the grounding conductor.

18. An apparatus for grounding an object to be coated via an electrostatic coating process, the object having a flexible grounding conductor coupled thereto, the apparatus comprising:

a grounding element and a correspondingly sized ground cover structurally coupled together and moveable relative to one another between a receiving position for receiving the flexible grounding conductor between said grounding element and said cover, and a covered position in which said cover at least partially encases said grounding element such that the flexible conductor is at least partially wrapped around said grounding element within said cover, at least one of said grounding element and said ground cover providing a grounding surface such that the conductor is grounded via contact with said grounding surface when in the apparatus in said covered position.

19. The apparatus of claim 18, said cover and said grounding element being pivotally movable relative to one another via a pivot structurally coupling said cover and said grounding element.

20. The apparatus of claim 18, wherein said grounding element is elongate.

21. The apparatus of claim 20, said elongate grounding element and said cover being pivotally movable relative to one another via a pivot structurally coupling an extremity of said elongate grounding element within said cover.

22. The apparatus of claim 18, the object being supported by a grounded support, the apparatus further comprising a conductive coupling mechanism conductively coupled to said grounding surface, said coupling mechanism for removably coupling the apparatus to the grounded support thereby grounding the object.

23. The apparatus of claim 22, said coupling mechanism comprising a clamping mechanism for conductively clamping the apparatus to the grounded support.

24. The apparatus of claim 23, said grounding element defining said at least one grounding surface, said clamping mechanism integrally coupled to said grounding element to thereby fixedly clamp said grounding element to the support, said cover being moveable relative to said fixedly clamped grounding element for receiving the conductor.

25. The apparatus of claim 23, said cover defining said at least one grounding surface, said clamping mechanism integrally coupled to said cover to thereby fixedly clamp said cover to the support, said grounding element being moveable relative to said cover for receiving the conductor.

26. The apparatus of claim 18, the object being supported by a grounded support, said cover defining said at least one grounding surface, said cover being fixedly coupled to the grounded support, said grounding element being moveable relative to said cover for receiving the conductor.

27. The apparatus of claim 18, the object being supported by a grounded support, said grounding element defining said at least one grounding surface, said grounding element being fixedly coupled to the grounded support, said cover being moveable relative to said structure for receiving the conductor.

28. The apparatus of claim 18, the flexible conductor comprising a foil tape.

29. The apparatus of claim 18, wherein the object is a plastic vehicle part, the flexible conductor being coupled to a conductive surface of the plastic vehicle part.

30. A method for grounding an object to be coated via electrostatic coating, using a grounding conductor, the method comprising the steps of:

supporting the object on a grounded support, the grounded support including a grounding apparatus on the support proximate a selected grounding location on the object; the grounding apparatus comprising: a grounding element and a ground cover structurally coupled to said grounding element, said ground cover and said grounding element being moveable relative to one another between a receiving position for receiving a grounding conductor for conductive coupling between grounding conductor and one of said grounding element and said cover, and a covering position for at least partially covering said conductive coupling, and wherein said cover at least partially encases said grounding element when in said covering position;

conductively coupling a first portion of the grounding conductor and the object at said selected grounding location; and forming said conductive coupling between a second portion of said grounding conductor and said grounding apparatus.

31. The method of claim 30, further comprising repeating the steps with at least a second grounding apparatus in respect of at least a second selected grounding location.

32. The method of claim 30, wherein the object is a plastic vehicle part and wherein said selected location is located on a conductive surface thereof.

33. A removable grounding apparatus for grounding an object to be coated via an electrostatic coating process, the object supported by a grounded support and having a first portion of a grounding conductor coupled to a selected location on the object, the apparatus comprising:

a conductive clamping mechanism for coupling the apparatus to the support proximate the selected location; and a grounding mechanism for conductive coupling with a second portion of the conductor and for at least partially covering said conductive coupling with said second portion of the conductor, said grounding mechanism comprising a structure and a correspondingly sized cover structurally coupled together and moveable relative to one another between a receiving position for receiving said second portion between said structure and said cover, and a covering position in which said cover at least partially encases said structure such that said second portion is at least partially wrapped around said structure within said cover.

34. The apparatus of claim 33, at least one of said structure and said cover providing a grounding surface conductively coupled to said clamping mechanism such that the grounding conductor is grounded via contact with said grounding surface when in the apparatus in said covering position.

35. The apparatus of claim 33, said grounding mechanism comprising a grounding element and a ground cover structurally coupled thereto, said ground cover and said grounding element being moveable relative to one another between a receiving position for receiving the grounding element for conductive coupling between said grounding element and said cover, and a covering position for at least partially covering said conductive coupling.

36. The apparatus of claim 33, the grounding conductor comprising a foil tape.

37. The apparatus of claim 33, wherein the object is a plastic vehicle part and wherein said selected location is located on a conductive surface thereof.

* * * * *